US007420136B2

(12) United States Patent
Goetzl et al.

(10) Patent No.: US 7,420,136 B2
(45) Date of Patent: Sep. 2, 2008

(54) COMPRESSION RING BUTTON ASSEMBLY

(75) Inventors: Brent Andrew Goetzl, Orinda, CA (US); Greg Gillis, Escondido, CA (US)

(73) Assignee: Radio Systems Corporation, Knoxville, TN (US)

( * ) Notice: Subject to any disclaimer, the term of this patent is extended or adjusted under 35 U.S.C. 154(b) by 0 days.

(21) Appl. No.: 11/530,337

(22) Filed: Sep. 8, 2006

(65) Prior Publication Data

US 2008/0060927 A1 Mar. 13, 2008

(51) Int. Cl.
*H01H 13/14* (2006.01)
*H01H 3/12* (2006.01)

(52) U.S. Cl. ..... 200/341; 200/302.2

(58) Field of Classification Search ..... 200/341, 200/302.2

See application file for complete search history.

(56) References Cited

U.S. PATENT DOCUMENTS 3,699,293 A * 10/1972 Portugall ..... 200/288
4,825,023 A * 4/1989 Morse ..... 200/302.2
5,545,865 A * 8/1996 Gotou ..... 200/341
7,067,754 B2 * 6/2006 Weston et al. ..... 200/314
7,235,755 B2 * 6/2007 Wang ..... 200/512

* cited by examiner

*Primary Examiner*—Elvin Enad
*Assistant Examiner*—Lheiren Mae A Anglo
(74) *Attorney, Agent, or Firm*—Pitts & Brittian, P.C.

(57) ABSTRACT

A button assembly for selectively actuating a switch. The button assembly (10) includes a button member (16) for being mounted in an opening of a housing. The button member (16) is fabricated of a resilient material and defines an outer surface (38) that can be depressed to bring the button assembly (10) into contact with the switch for purposes of actuating the switch. The button assembly (10) also includes a compression ring (26) for being received in a bore (28) provided in the button member (16) whereby the compression ring (26) compresses the button member against the edges of the housing that define the opening in the housing creating a substantially liquid impervious seal and holding the button assembly (10) in place in the opening.

21 Claims, 2 Drawing Sheets

COMPRESSION RING BUTTON ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to a button assembly for actuating a switch or other mechanism that requires actuation. More specifically the button assembly of the present invention is designed to be mounted in an opening in the housing of an electronic device to provide a mechanism for actuating a switch mounted within the housing.

2. Description of the Related Art

Electronic devices are commonly provided with button assemblies that allow switches, or other mechanisms mounted within the housing of the device, to be actuated from outside of the device. Typically such button assemblies include a button member that is mounted in an opening in the housing of the electronic device. When depressed, the button causes the switch, or other mechanism within the housing, to be actuated. Generally, such button assemblies can be relatively uncomplicated and inexpensive, and can be designed for easy installation in the housing. This lack of complexity allows manufacturing costs to be held to a minimum. However, where the housing of the electronic device must be hermetically sealed to protect the electronics housed therein, the fluid impervious mounting of a button assembly in the housing can be problematic. Providing for a functioning button, while maintaining a fluid impervious seal at the opening in which the button assembly is mounted, can greatly increase the complexity of the button assembly. Also, the complexity of a design that accommodates a fluid impervious seal tends to greatly increase the difficulty of installation. Moreover, this complexity in design and difficulty of installation leads to significant increases in manufacturing costs.

In light of the above, it will be recognized that it is advantageous to have a button assembly that mounts in an opening in the housing of an electronic device and fluid imperviously seals the opening. It is advantageous to have such a button assembly that is not overly complex in design and can be quickly and easily installed so as to minimize manufacturing costs.

BRIEF SUMMARY OF THE INVENTION

The compression ring button assembly of the present invention is designed to be mounted in an opening in a housing of an electronic device. According to one embodiment of the present invention, the compression ring button assembly includes a button member that is preferably fabricated of a fluid impervious elastomeric material. The button member defines an outer body portion for being maintained on the exterior of the housing of the electronic device, and a barb portion for being maintained in the interior of the housing. A channel is defined in the button member which extends around the perimeter of the button member, and which is receptive of the ridged edge which defines the opening in the housing. Thus, during the mounting of the button assembly in the housing, the resilient button member is inserted into the opening in the housing. When the edge of the housing seats in the channel, the barb portion and the outer body portion of the button member hold the button member in position in the opening.

The button assembly also includes a compression ring which is dimensioned for force fit reception into a bore provided in the button member. This force fit reception of the compression ring into the bore compresses the resilient material of the button member against the edge of the opening in the housing creating a fluid impervious or hermetic seal between the button member and the housing. In one embodiment the compression ring is provided with a barb portion at its distal end which engages a shoulder portion defined by the button member within the bore. After the compression ring is inserted into the bore, the barb portion engages the shoulder portion and prohibits the compression ring from backing out of the bore during normal operation of the button assembly.

In one embodiment the button assembly also includes a button plunger which is received in a second bore in the rear of the button member, and which extends outwardly therefrom. When pressure is applied to the outer surface of the button member, the button plunger moves rearward to engage and actuate a switch or other mechanism which is to be actuated.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
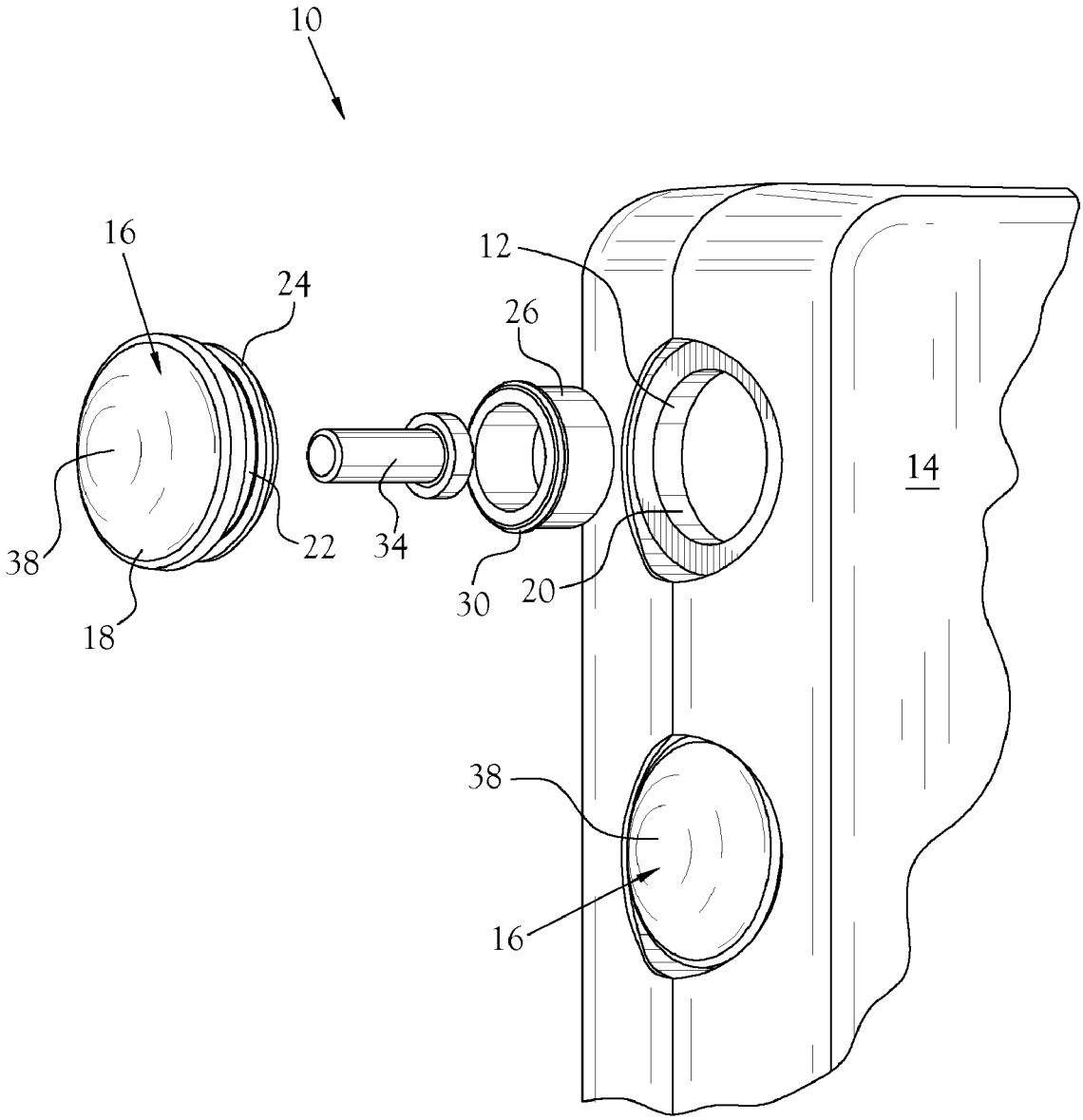
FIG. 1 is a perspective view of a compression ring button assembly of the present invention.
Figure 2:
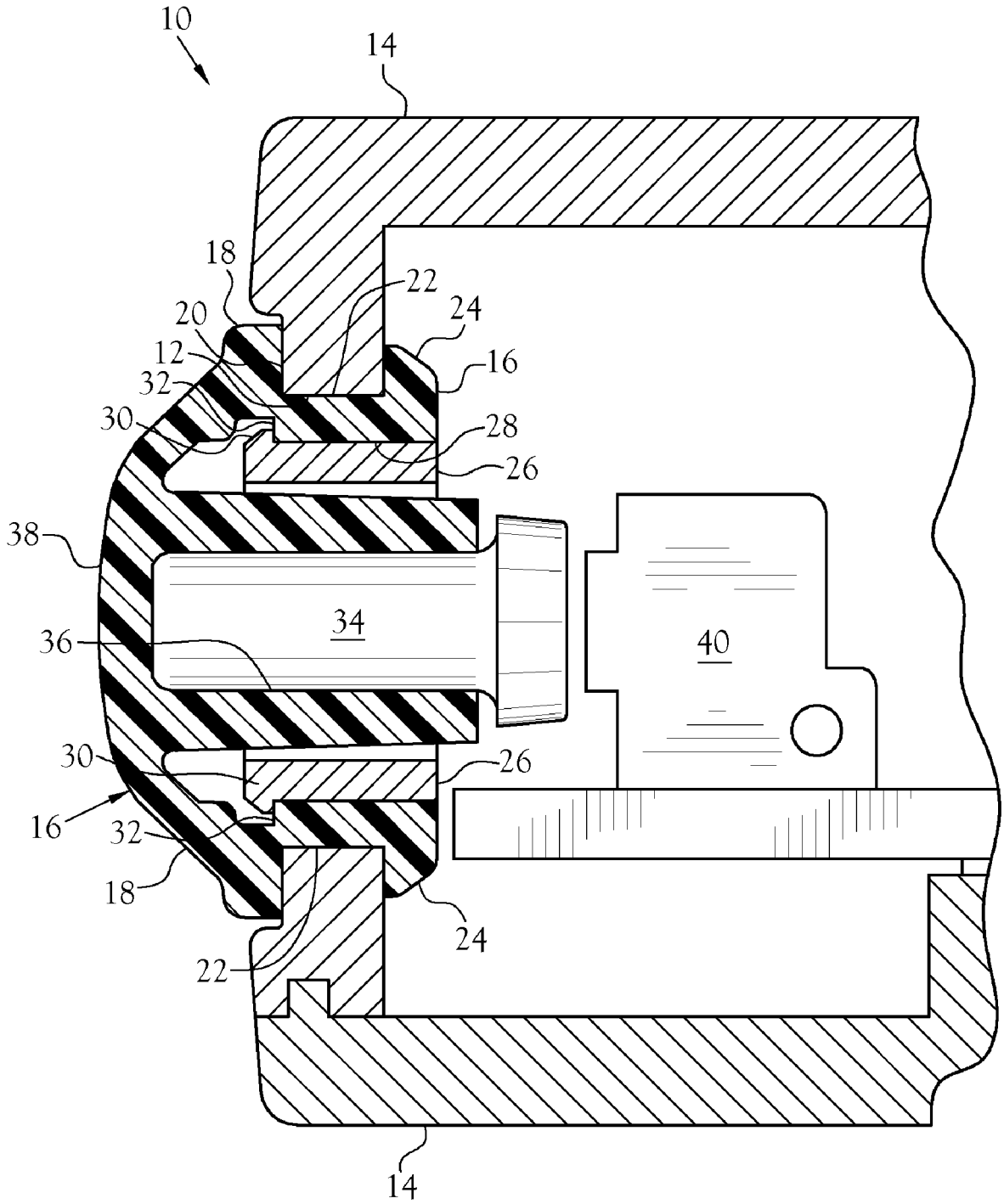
FIG. 2 is a side elevation view, in section, of a compression ring button assembly of the present invention.

The compression ring button assembly of the present invention is reference generally at 10 in the FIGS. 1 and 2. The button assembly 10 is designed to be used as an actuating mechanism for actuating various types of electronic and/or mechanical switches. For purposes of this application the word "switch" in intended to include any of various devices or mechanisms which can be actuated by operation of a button. As will be discussed further below, the compression ring button assembly 10 is designed to be mounted in an opening 12 in the housing 14 of an electronic device to provide a mechanism for actuating a switch 40 mounted within the housing 14. The assembly 10 seats in the opening 12 such that the assembly 10 covers the opening 12 and a fluid impervious seal is create between the button assembly 10 and the housing 14. Thus, the button assembly 10 is particularly useful where the housing of an electronic device must be fluid impervious.

The button assembly 10 includes a button member 16 which is preferably fabricated of a fluid impervious elastomeric material such as rubber, EPDM (ethylene propylene diene rubber), thermal plastic elastomer (TPR), silicon, or the like. The button member 16 is illustrated as defining an annular or circular shape in FIGS. 1 and 2, but it will be understood that it could define various shapes and sizes. Further, in one embodiment the button member 16 defines an outer body portion 18 for being maintained on the exterior of the housing 14, and a barb portion 24 for being maintained on the interior of the housing 14. Accordingly, in that particular embodiment a channel 22 is defined which extends around the perimeter of the button member 16, and which is receptive of the ridged edge 20 which defines the opening 12. Thus, during the mounting of the button assembly 10 in the housing 14 the resilient button member 16 is inserted into the opening 12, and when the edge 20 of the housing 14 seats in channel 22 the barb portion 24 and the outer body portion 18 of the button member 16 hold the button member 16 in position in the opening 12. Whereas the barb portion 24 is illustrated in the drawings as a continuous lip, it will be understood by those skilled in the art that the barb portion 24 need not be continuous, and could be composed of a plurality of barb segments which engage the housing 14 and maintain the position of the button member 16.

The button assembly 10 also includes a compression ring 26 which is dimensioned for force fit reception into a bore 28 provided in the button member 16. This force fit reception of the compression ring 26 into the bore 28 compresses the resilient material of the button member 16 against the edge 20 of the opening 12 creating a fluid impervious or hermetic seal between the button member 16 and the housing 14. It will be noted that in the illustrated embodiment the bore 28 is substantially circular and the compression ring 26 is substantially cylindrical. Further, the exterior or the compression ring 26 defines a larger diameter than the bore 28 such that upon force fit insertion of the compression ring 26 into the bore 28, the button member 16 is compressed against the housing 14. However, it will be understood by those skilled in the art that the bore and compression ring 26 could define various mating configurations and the illustrated circular/cylindrical design is simply illustrative of one embodiment. Further, in one embodiment the compression ring 26 is fabricated of a polycarbonate material, but a thermo plastic, metal, or various other substantially rigid materials could be used.

It will also be noted that in the illustrated embodiment the compression ring 26 is provided with a barb portion 30 at its distal end which engages a shoulder portion 32 defined by the button member 16. It will be appreciated that after the compression ring 26 is inserted into the bore 28, the barb portion 30 engages the shoulder 32 and prohibits the compression ring 26 from backing out of the bore 28 during normal operation of the button assembly 10. Whereas the barb portion 30 is illustrated in the drawings as a continuous lip, it will be understood by those skilled in the art that the barb portion 30 need not be continuous, and could be composed of a plurality of barb segments which engage the shoulder 32 and maintain the position of the compression ring 26 in the button member 16.

In one embodiment the button assembly 10 also includes a button plunger 34 which is received in a second bore 36 in the rear of the button member 16, and which extends outwardly therefrom. As those skilled in the art will recognize, when pressure is applied to the outer surface 38 of the button member 16, the button plunger 34 moves rearward to engage and actuate a switch, such as the illustrated switch 40 of FIG. 2. It will be understood in this regard, that a separate button plunger 34 and the second bore 36 need not be provided, and the body of the button member 16 can be used to engage and actuate the switch 40. However, it is contemplated that the button plunger 34 will be fabricated of a rigid material such as a metal, plastic or the like. Consequently, the rigid button plunger 34 provides a more tactile feel of the switch 40 by transferring the switch's on/off feedback through the outer surface 38 of the button member 16 and back to the user's finger. It will also be noted that the button plunger 34 could be fabricated such that only the portion of the plunger 34 which engages the switch 40 is made of a rigid material.

From the foregoing description, it will be recognized by those skilled in the art that the button assembly 10 provides great advantages over the prior art. The button assembly 10 can be quickly and easily mounted in the opening of the housing of an electronic device. As mounted, the button assembly 10 allows easy actuation of a switch, while it seals against the housing so as to maintain the fluid impervious integrity of the housing. Further, where the button plunger 34 is incorporated, a better tactile feel of the switch 40 is provided to insure that the desire actuation is achieved.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A button assembly for selectively actuating a switch and for being mounted in an opening provided in a housing, said button assembly comprising:

a button member for being mounted in a through-opening of the housing, said button member being fabricated of a resilient material and defining a bore, said button member defining an outer surface, whereby selective pressure on said outer surface brings said button member into contact with the switch for purposes of actuating the switch; and at least one compression ring for being received in said bore of said button member, said compression ring compressing said button member against the edges of the housing defining the through opening in the housing to create a substantially liquid impervious seal and to hold said button assembly in place in the opening.

2. The button assembly of claim 1 wherein said button member defines a channel extending around a perimeter of the button member which is receptive of an edge portion of the housing that defines the through opening in which the button assembly is mounted, whereby said button member is held in position in said opening.

3. The button assembly of claim 2 wherein said button member further comprises a first flange adapted to engage the exterior of the housing and a second flange engaging the interior of the housing, said button member, said first flange, and said second flange cooperating to define a channel adapted to receive the edges of the housing.

4. The button assembly of claim 1 wherein said bore of said button member is substantially cylindrical and defines a first diameter, and the exterior of said compression ring is substantially cylindrical and defines a second diameter, said second diameter be greater than said first diameter, said compression ring being received in said bore and compressing said button member against the edges of the housing defining the through opening to create a substantially liquid impervious seal and secure said button assembly within the opening.

5. The button assembly of claim 1 wherein said button member is fabricated of a fluid impervious elastomeric material.

6. A button assembly for selectively actuating a switch and for being mounted in an opening provided in a housing, said button assembly comprising:

a button member for being mounted in the opening of the housing, said button member being fabricated of a fluid impervious elastomeric material and defining a bore opening into the interior of the housing when said button assembly is mounted in the through opening, said button member defining an outer surface disposed on the exterior of the housing when said button assembly is mounted in the through opening, said button assembly actuating the switch when selective pressure is applied to said outer surface of said button assembly, said button member defining a channel extending around a perimeter of the button member, said channel receiving an edge portion of the housing that defines the through opening in which the button assembly is mounted to secure said button member in said through opening; and at least one compression ring received in said bore of said button member, said compression ring compressing said button member against the edges of the housing defining the through opening in the housing creating a substantially liquid impervious seal and holding said button assembly in place in the opening, said bore of said button member defining a substantially cylindrical surface portion having a first diameter, and the exterior of said compression ring defining a substantially cylindrical surface portion having a second diameter, said second diameter being greater than said first diameter.

7. A button assembly for selectively actuating a switch and for being mounted in an opening provided in a housing, said button assembly comprising:

a button member for being mounted in the opening of the housing, said button member being fabricated of a fluid impervious elastomeric material and defining a first bore that opens into the interior of the housing when said button assembly is mounted in the opening, said button member defining a shoulder portion within said first bore, said button member also defining a second bore that opens into the interior of the housing as said button assembly is mounted in the opening, said button member defining an outer surface disposed on the exterior of the housing when said button assembly is mounted in the opening, whereby selective pressure on said outer surface brings said button assembly into contact with the switch for purposes of actuating the switch, said button member defining a channel extending around a perimeter of the button member that is receptive of an edge portion of the housing that defines the opening in which the button assembly is mounted, whereby said button member is held in position in said opening;

a compression ring for being received in said first bore of said button member whereby said compression ring compresses said button member against the edges of the housing defining the opening in the housing creating a substantially liquid impervious seal and holding said button assembly in place in the opening, said first bore of said button member defining a substantially cylindrical surfaced portion having a first diameter, and the exterior of said compression ring defining a substantially cylindrical surface portion defining a second diameter, said second diameter being greater than said first diameter whereby insertion of said compression ring into said bore compresses said button member against the edges of the housing defining the opening in the housing thereby creating a substantially liquid impervious seal and holding said button assembly in place in the opening, said compression ring defining a distal end having a barb portion for engaging said shoulder portion within said first bore, whereby the engagement of said barb portion of said compression ring with said shoulder portion within said first bore inhibits said compression ring from backing out of said first bore during normal operation of said button assembly; and a button plunger for being received in said second bore and for selectively engaging the switch, at least a portion of said button plunger being fabricated of a rigid material for engaging the switch, whereby selective pressure on said outer surface of said button member brings said button plunger into contact with the switch for purposes of actuating the switch.

8. A button assembly for selectively actuating a switch and for being mounted in an opening provided in a housing, said button assembly comprising:

a button member for being mounted in the opening of the housing, said button member being fabricated of a resilient material and defining a bore, said button member defining an outer surface, whereby selective pressure on said outer surface brings said button assembly into contact with the switch for purposes of actuating the stitch; and at least one compression ring for being received in said bore of said button member whereby said compression ring compresses said button member against the edges of the housing defining the opening in the housing creating a substantially liquid impervious seal and holding said button assembly in place in the opening, wherein said button member defines an outer body portion for being maintained on the exterior of the housing and a barb portion for being maintained in the interior of the housing with said channel being defined between said outer body portion and said barb portion.

9. A button assembly for selectively actuating a switch, said button assembly comprising:

a housing defining a through-opening, said housing having a bounding surface connecting said exterior surface and said interior surface and bounding said through-opening;

a button member mounted in and covering said through-opening, said button member comprising a contact portion having an interior surface and an exterior surface and a projection extending from said contact portion interior surface, said contact portion substantially covering said through-opening, said projection received within said through-opening, and said projection having an exterior surface for engaging said bounding surface and an interior surface, said button member defining a cavity, said button member being fabricated from an elastomeric material;

a compression member disposed within said cavity, said compression member engaging said projection interior surface and forcing said projection exterior surface against said bounding surface to form a substantially watertight seal, said compression member defining a central pass-through; and a plunger disposed within said button member cavity, said plunger having a first end engaging said button member contact portion and a second end adapted for operatively engaging a switch.

10. The button assembly of claim 9 wherein said housing defines an interior surface and an exterior surface, said projection having an exterior flange extending from said projection exterior surface, an interior flange extending from said projection exterior surface, said exterior flange engaging said housing exterior surface and said interior flange engaging said housing interior surface with said bounding surface being received between said exterior flange and said interior flange for securing said button member within said through-opening.

11. The button assembly of claim 9 wherein said projection interior surface includes a lip and said compression member includes a flange, said compression member flange engaging said projection interior surface lip for securing said compression member within said button member.

12. The button assembly of claim 9 wherein said compression member has an exterior diameter, said through-opening has a diameter, and said projection has an uncompressed width, said projection uncompressed width plus said exterior diameter being slightly greater than said through-opening diameter, said projection being sufficiently compressible to allow the combined width of said projection when compressed and said compression member exterior diameter to match said through-opening diameter.

13. The button assembly of claim 9 wherein said button member further comprises a guide positioned proximate to the center of said contact portion and extending from said contact portion interior surface through said compression member pass-through, said guide receiving and positioning said plunger proximate to the center of said contact portion.

14. The button assembly of claim 9 wherein said plunger first end is connected and extends from said contact portion interior surface, said plunger second end extending through said compression member pass-through.

15. A button assembly for selectively actuating a switch and for being mounted in an opening provided in a housing, said button assembly comprising:

a button member for being mounted in the opening of the housing, said button member being fabricated of a resilient material and defining a bore, said button member defining an outer surface, whereby selective pressure on said outer surface brings said button assembly into contact with the switch for purposes of actuating the switch, said button member defines a shoulder portion within said bore; and at least one compression ring received in said bore of said button member, said compression ring compressing said button member against the edges of the housing defining the opening in the housing creating a substantially liquid impervious seal and holding said button assembly in place in the opening, said compression ring defining a distal end having a barb portion engaging said shoulder portion within said bore and inhibiting said compression ring from backing out of said bore during normal operation of said button assembly.

16. A button assembly for selectively actuating a switch and for being mounted in an opening provided in a housing, said button assembly comprising:

a button member for being mounted in the opening of the housing, said button member being fabricated of a resilient material and defining a bore, said button member defining an outer surface, whereby selective pressure on said outer surface brings said button assembly into contact with the switch for purposes of actuating the switch, said button member defines a second bore that opens into the interior of the housing when said button member is mounted in the opening;

a button plunger received in said second bore, said button plunger engaging the switch when pressure is applied to said outer surface of said button member; and at least one compression ring received in said bore of said button member, said compression ring compressing said button member against the edges of the housing defining the opening in the housing creating a substantially liquid impervious seal and holding said button assembly in place in the opening.

17. The button assembly of claim 16 wherein said button plunger is fabricated of a rigid material.

18. A button assembly for selectively actuating a switch and for being mounted in an opening provided in a housing, said button assembly comprising:

a button member for being mounted in the opening of the housing, said button member being fabricated of a fluid impervious elastomeric material and defining a bore opening into the interior of the housing when said button assembly is mounted in the opening, said button member defining a shoulder portion within said bore, said button member defining an outer surface disposed on the exterior of the housing when said button assembly is mounted in the opening, said button assembly actuating the switch when selective pressure is applied to said outer surface of said button assembly, said button member defining a channel extending around a perimeter of the button member, said channel receiving an edge portion of the housing that defines the opening in which the button assembly is mounted to secure said button member in said opening; and at least one compression ring received in said bore of said button member, said compression ring compressing said button member against the edges of the housing defining the opening in the housing creating a substantially liquid impervious seal and holding said button assembly in place in the opening, said bore of said button member defining a substantially cylindrical surface portion having a first diameter, and the exterior of said compression ring defining a substantially cylindrical surface portion having a second diameter, said second diameter being greater than said first diameter, said compression ring defining a distal end having a barb portion for engaging said shoulder portion within said bore, said barb portion engaging said shoulder portion to inhibit said compression ring from backing out of said bore during normal operation of said button assembly.

19. The button assembly of claim 18 wherein said button member defines a second bore that opens into the interior of the housing as said button assembly is mounted in the opening, and wherein said button assembly further comprises a button plunger received in said second bore, said button plunger actuating the switch when pressure is applied to said outer surface of said button member.

20. The button assembly of claim 11 wherein said button plunger is fabricated from a rigid material.

21. A button assembly for selectively actuating a switch and for being mounted in an opening provided in a housing, said button assembly comprising:

a button member for being mounted in the opening of the housing, said button member being fabricated of a fluid impervious elastomeric material and defining a bore opening into the interior of the housing when said button assembly is mounted in the opening, said button member defining a shoulder portion within said bore, said button member defining an outer surface disposed on the exterior of the housing when said button assembly is mounted in the opening, said button assembly actuating the switch when selective pressure is applied to said outer surface of said button assembly, said button member defining a channel extending around a perimeter of the button member, said channel receiving an edge portion of the housing that defines the opening in which the button assembly is mounted to secure said button member in said opening; and at least one compression ring received in said bore of said button member, said compression ring compressing said button member against the edges of the housing defining the opening in the housing creating a substantially liquid impervious seal and holding said button assembly in place in the opening, said bore of said button member defining a substantially cylindrical surface portion having a first diameter, and the exterior of said compression ring defining a substantially cylindrical surface portion having a second diameter, said second diameter being greater than said first diameter, said compression ring defining a distal end having a barb portion for engaging said shoulder portion within said bore, said barb portion engaging said shoulder portion to inhibit said compression ring from backing out of said bore during normal operation of said button assembly.

* * * * *